US006035940A

United States Patent [19]

Bourke

[11] Patent Number: 6,035,940

[45] Date of Patent: Mar. 14, 2000

[54] PORTABLE FIRE FIGHTING APPARATUS

[76] Inventor: Kevin Bourke, 72 Jersey Ave., Greenwood Lake, N.Y. 10925

[21] Appl. No.: 09/223,917

[22] Filed: Dec. 31, 1998

[51] Int. Cl.[7] ..... A62C 3/00

[52] U.S. Cl. ..... 169/47; 169/70; 239/80; 239/283; 239/532; 134/166 R; 134/198

[58] Field of Search ..... 169/54, 70, 46, 169/47

[56] References Cited

U.S. PATENT DOCUMENTS

| | | | |
|---|---|---|---|
| 154,980 | 9/1874 | Farrier | D23/213 |
| D. 264,010 | 4/1982 | Graf | D29/5 |
| D. 324,562 | 3/1992 | Heitz | D23/213 |
| D. 344,217 | 2/1994 | Weiss | D8/2 |
| 473,716 | 4/1892 | Stevens . | |
| 1,043,107 | 11/1912 | Howe et al. | 248/79 |
| 1,476,810 | 12/1923 | Gilsenan | 239/282 |
| 1,493,498 | 5/1924 | Pluym . | |
| 1,667,342 | 4/1928 | Blaw . | |
| 2,592,053 | 4/1952 | Megla . | |
| 2,793,701 | 5/1957 | Scott et al. | 169/70 |
| 5,083,618 | 1/1992 | Hayes | 169/54 |

*Primary Examiner*—Andres Kashnikow
*Assistant Examiner*—Christopher S. Kim
*Attorney, Agent, or Firm*—Goldstein & Canino

[57] ABSTRACT

A fire fighting apparatus that is mounted to a window sill of the floor with a fire therein. The fire fighting apparatus comprises a substantially elongated conduit having an opening on its upper end, an anchor arm mounted from the opening on the conduit and a waterway securely fastened to the conduit. A fire hose is secured to the bottom of the waterway to supply water to the fire fighting apparatus. The anchor arm comprises a horizontal portion that fits on top of the window sill of the burning floor to securely suspend the fire fighting apparatus thereon. The anchor arm has a wedge-shaped claw that may be used to break open or to pry open a shut window.

12 Claims, 3 Drawing Sheets

PORTABLE FIRE FIGHTING APPARATUS

BACKGROUND OF THE INVENTION

The invention relates to a fire fighting apparatus. More particularly, the invention relates to a portable fire fighting apparatus that is detachable and facilitates in fighting fires that are difficult to access by ground and tower ladders.

Housing space is generally a scarcity in densely populated areas, because demand for housing space usually exceeds supply of housing space. As a result, builders and architects continue to endeavor for maximizing the use of the available limited space. Those who live in metropolitan areas are quite familiar with high rise buildings, popularly known as skyscrapers, which can house a significant number of people in a relatively small geometric area.

Not only do high rise buildings provide an easy way to house a number of families, but also a convenient and economical way to locate a plurality of business establishments in a given area. As a result, high rise buildings continue to be built at a furious pace.

Significant efforts have been made to improve the quality of living and/or working in skyscrapers. Nevertheless, there are areas where more improvements need to be made. One such area relates to providing easy accessibility to higher floors in high rise buildings. The lack of an easy access becomes an even more acute problem during a fire on one of the higher floors. Unfortunately, only stairs or elevators provide a quick and easy way to access higher floors in high rise buildings. Consequently, to fight a fire on a higher floor, fire fighters must risk their lives by physically going onto the floor and dosing the flames with water.

Unfortunately, most fires produce an abundance of smoke and fumes which get inhaled and result in severe injuries to the fire fighters. Consequently, it is desirable to provide an apparatus that facilitates fighting fires without having to physically go on the floor with the fire.

A few patents disclose mechanisms that attempt to aid fire fighters in their jobs. For example, U.S. Pat. No. 154,980 to Farrier discloses a hose anchor that allows attachment of a fire hose to the ground. U.S. Pat. No. 473,716 to Stevens discloses a connection for a hose pipe that provides a swiveling support to the pipe.

While the above-mentioned prior art units may be suitable for the particular purpose employed, or for general usage, they would not be as suitable for the purposes of the present invention as disclosed hereinafter.

SUMMARY OF THE INVENTION

It is an object of the invention to provide a fire fighting apparatus that facilitates with putting out fires in areas which are difficult to reach within a building.

It is a further object of the invention to provide a fire fighting apparatus that aids in putting out fires on floors that are difficult to access by ground and tower ladders or are inaccessible due to the flames from the fire. Accordingly, the present invention discloses a portable fire fighting apparatus that is detachable to allow easy transportation. The fire fighting apparatus comprises an anchor arm that secures the fire fighting apparatus to a window sill on the floor with the fire. The fire fighting apparatus has a waterway that connects to a fire hose, wherein the waterway extends into the floor with the fire and sprays water onto the flames.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims and their legal equivalents.

BRIEF DESCRIPTION OF THE DRAWINGS

The above and other aspects, features and advantages of the present invention will be more apparent from the following detailed description thereof, which is presented in conjunction with the following drawings, wherein corresponding reference characters indicate corresponding components throughout the drawing figures.

DETAILED DESCRIPTION OF THE PREFERRED EMBODIMENTS

Figure 1:
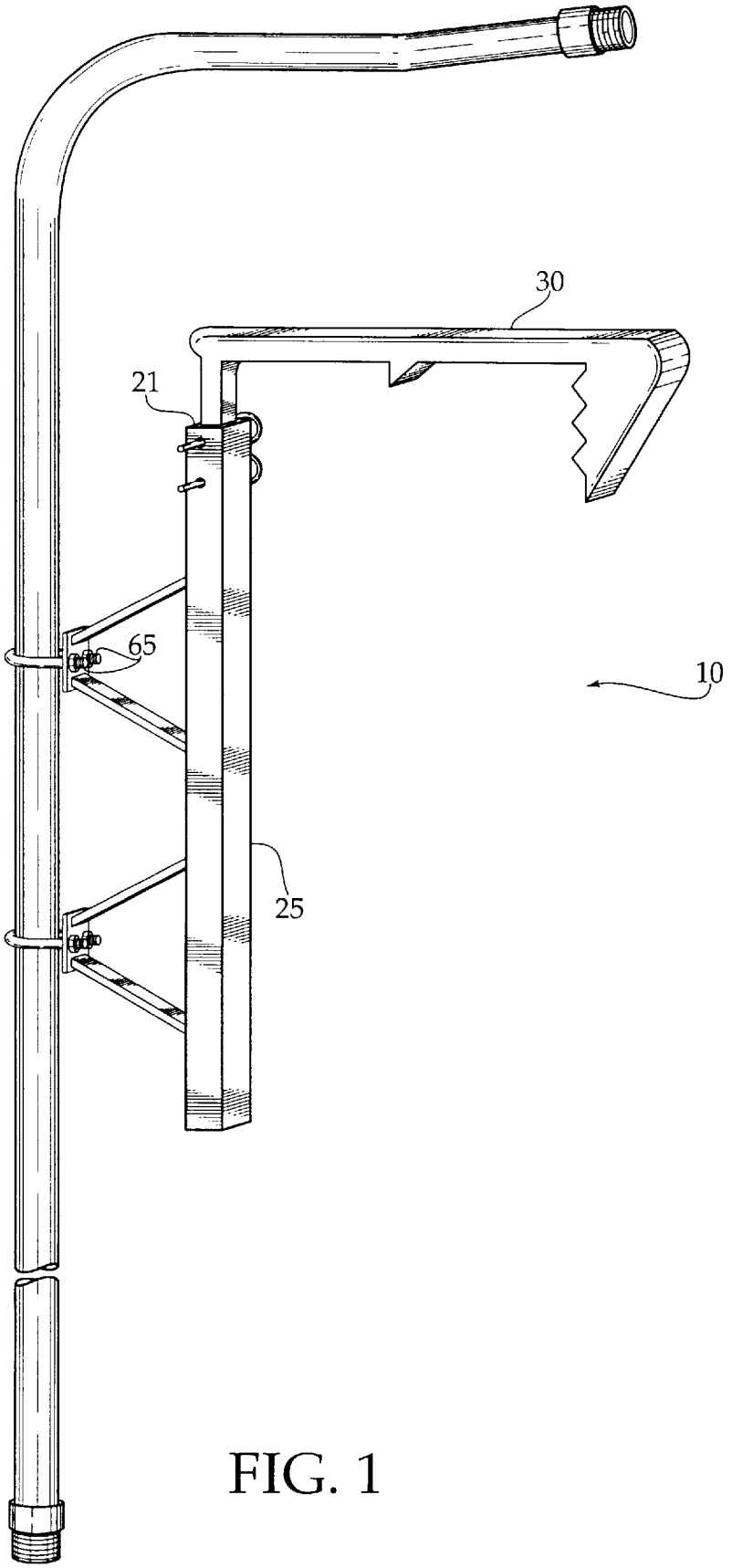
FIG. 1 is a diagrammatic perspective view of the fire fighting apparatus, in accordance with the present invention.
Figure 2:
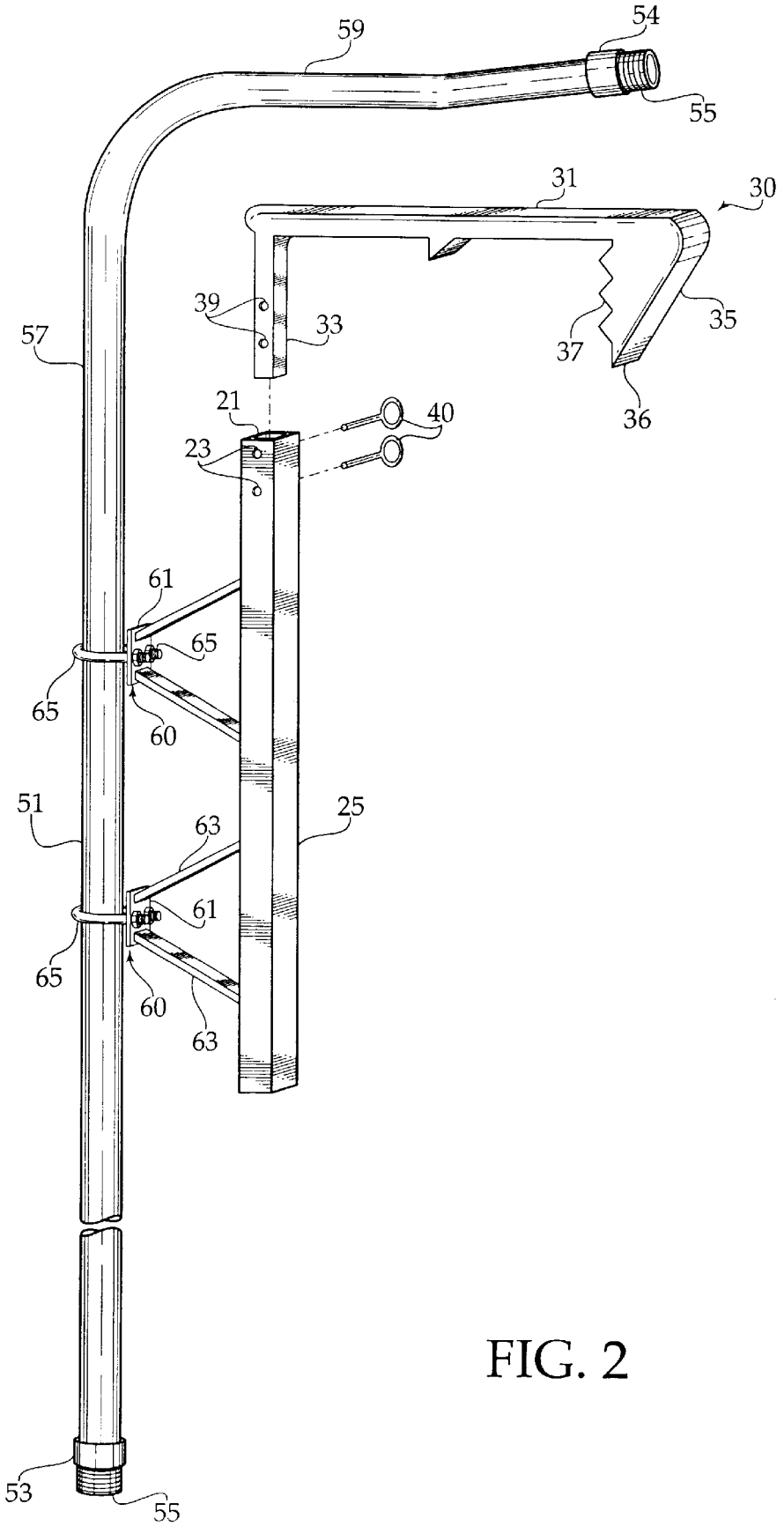
FIG. 2 is a diagrammatic perspective view of the fire fighting apparatus with the anchor arm removed from the opening on top of the conduit.
Figure 3:
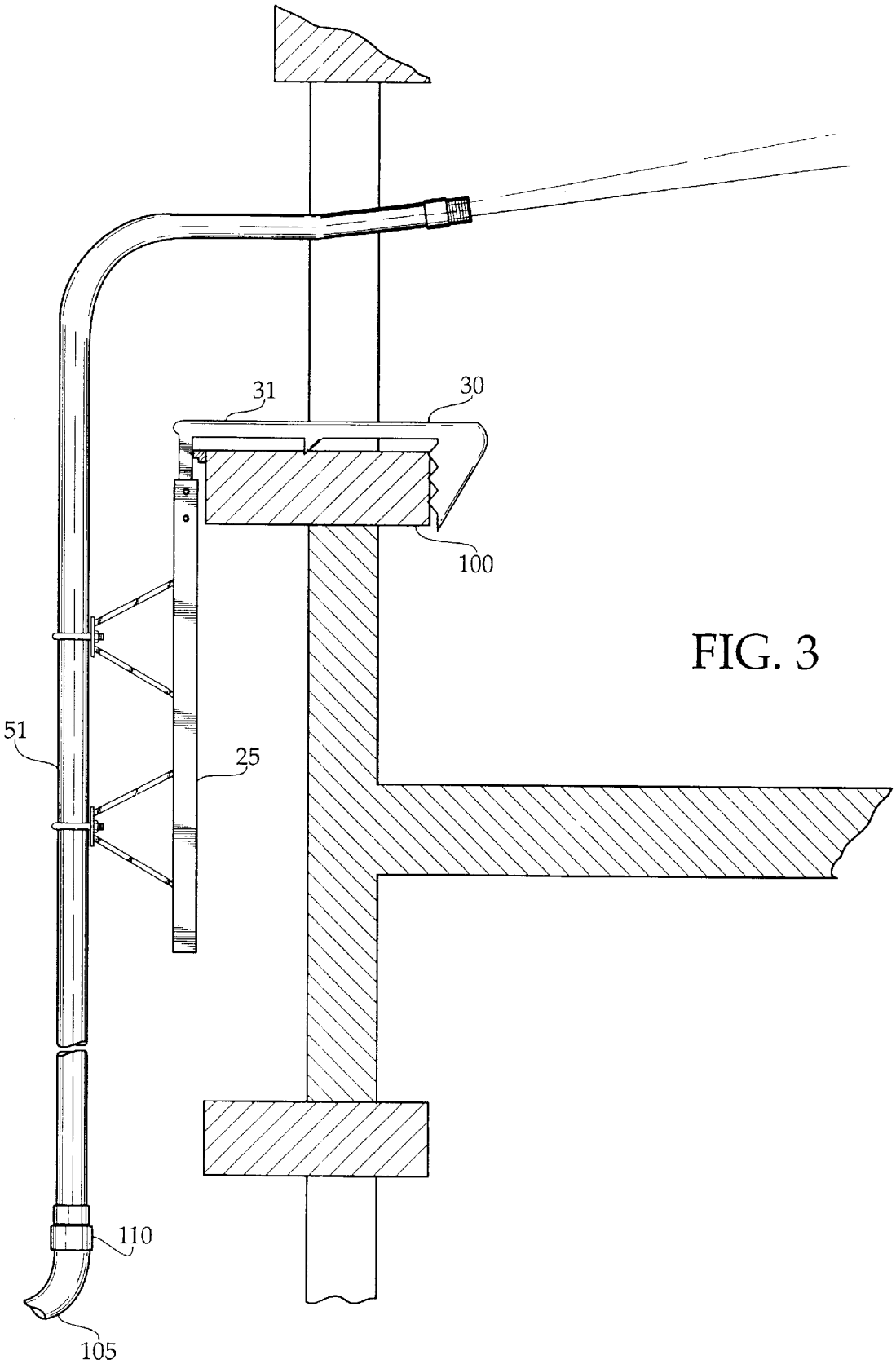
FIG. 3 is a diagrammatic perspective view of the fire fighting apparatus mounted on a window sill of the floor with the fire, in accordance with the present invention.

FIGS. 1–3 illustrate the present invention, which relates to a fire fighting apparatus 10 that is mounted with a fire hose 105. As shown in FIG. 3, the fire fighting apparatus 10 comprises an anchor arm 30 that is capable of being securely mounted on top of a window sill 100, and a substantially elongated conduit 25. An opening 21 is provided on top of the conduit 25, which secures the anchor arm 30 therein.

As shown in FIG. 2, the anchor arm 30 is substantially U-shaped. The anchor arm 30 has a horizontal portion 31 that generally lies flush against the window sill 100 (FIG. 3), a wedge-shaped claw 35 and a vertical stem 33. The vertical stem 33 is inserted into the opening 21 on top of the conduit 25 to secure the anchor arm 30 therein. According to the invention, the vertical stem 33 and the claw 35 are located on opposite ends of the horizontal portion 31, wherein both the vertical stem 33 and the claw 35 extend downward from the horizontal portion 31.

The claw 35 of the anchor arm 30 is provided with a sharp edge 36 that is strong enough to break open windows. The sharp edge 36 enables a user to pry open windows that are shut. The claw 35 is provided with a ridged surface 37 which securely holds onto the side of the window sill 100 that lies within the floor with the fire, as shown in FIG. 3. As a result of the anchor arm 30 securely holding onto the sides of the window sill 100, the fire fighting apparatus 10 is firmly suspended from the window sill 100.

To allow easy securement of the vertical stem 33 within the opening 21 on the conduit 25, the opening 21 is slightly larger in diameter than vertical stem 33 of the anchor arm 30. The vertical stem 33 has a pair of holes 39 and the conduit 25 is provided with a pair of matching holes 23. To mount the vertical stem 33 on top of the conduit 25, the vertical stem 33 is inserted into the opening 21 of the conduit 25 and the holes 39 on the vertical stem 33 are lined up with the matching holes 23 on the conduit 25. Once the holes 39 on the vertical stem 33 are lined up with the matching holes 23, pins 40 are inserted therethrough which secures the vertical stem 33 on top of the conduit 25.

A waterway 51 is mounted to the conduit 25 by a pair of securement means 60. Each of the securement means 60 has a mounting plate 61 that is attached to a pair of connector extensions 63 that extend horizontally from the conduit 25. A U-shaped fastener 65 is provided, wherein the fastener 65 is placed around the waterway 51 and detachably mounted to the mounting plate 61 by a pair of nuts 65.

The waterway 51 has a vertical section 57 and a horizontal section 59. The vertical section 57 lies parallel to the side of the building when the fire fighting apparatus 10 is mounted from the window sill 100, whereas the horizontal section 59 extends into the floor with the fire.

The waterway 51 has a bottom end 53 at the bottom of the vertical section 57 and an upper end 54 on the horizontal section 59. The upper end 54 and the bottom end 53 have a threaded fitting 55. The threaded fitting 55 on the bottom end 53 securely engages with a coupling 110 attached to the fire hose 105 to secure the fire hose 105 thereto. As a result, when the water supply is turned on, the water flows from the fire hose 105 into the waterway 51 through the bottom end 53 and is sprayed onto the fire from the upper end 54. According to one embodiment, it is possible to attach a pipe from the threaded fitting 55 on the upper end 54 of the waterway 51 for reaching fires in areas distal from the window sill 100 that has the fire fighting apparatus 10 mounted thereon.

To use the fire fighting apparatus 10, the anchor arm 31 is detached from conduit 25 and transported to a floor beneath the floor with the fire. Once the detached fire fighting apparatus 10 is on the appropriate floor, the vertical stem 33 of the anchor arm 31 is mounted into the opening 21 of the conduit 25. The fire fighting apparatus 10 is raised upward from a window that lies directly beneath the window sill 100 of the floor with the fire. The anchor arm 31 is hooked onto the window sill 100, such that the horizontal portion 31 lies flush against the window sill 100. As a result, the fire fighting apparatus 10 is securely suspended from the window sill 100 of the floor with the fire.

Once the anchor arm 31 is firmly mounted on the window sill 100, the waterway 51 is secured to the conduit 25 by the securement means 60 and the fire hose 105 is secured to the waterway 51. As a result, when the water supply is turned on, the fire hose 105 feeds the water to the waterway 51, which sprays the water on the fire through its upper end 54.

In summary, the present invention relates to a fire fighting apparatus 10. According to the invention, the fire fighting apparatus 10 is extended upward from a floor below the floor with the fire and secured to top of a window sill 100. Once the fire fighting apparatus 10 is securely attached to the window sill 100, a fire hose 105 is attached thereto and the water supply is turned on. The fire hose 105 supplies water to the fire fighting apparatus 10, which douses the fire with the supplied water.

The fire fighting apparatus 10 is uniquely advantageous in that it ensures that the fire is doused with water without requiring a person to manually handle the fire hose. As a result, fire fighters do not have to be physically present on the floor while the fire is being tamed by the water doused.

Many specific details contained in the above description merely illustrate some preferred embodiments and should not be construed as a limitation on the scope of the invention. Accordingly, many other variations are possible within the spirit of the present invention, limited only by the scope of the appended claims and their legal equivalents.

What is claimed is:

1. A fire fighting apparatus that assists in fighting fires in high rise buildings, the fire fighting apparatus is mounted to a window sill of a floor with a fire therein, comprising:

a substantially elongated conduit having an upper portion, said upper portion provided with an opening;

an anchor arm mounted from said opening of said conduit, said anchor arm being capable of fitting on top of the window sill for securely attaching the fire fighting apparatus therefrom; and a waterway that is capable of spraying water onto the fire, said waterway securely attached to said conduit.

2. The fire fighting apparatus of claim 1, wherein said anchor arm comprises:

a horizontal portion that lies flush against the window sill when the fire fighting apparatus is mounted therefrom;

a vertical stem that is securely fitted within said opening on the top of said conduit; and a wedge-shaped claw.

3. The fire fighting apparatus of claim 2, wherein said wedge-shaped claw is provided with a sharp tip for allowing users to break open a glass window.

4. The fire fighting apparatus of claim 3, wherein said wedge-shaped claw is provided with a ridged surface that securely holds the window sill from a side that lies within the floor with the fire.

5. The fire fighting apparatus of claim 2, wherein the vertical stem is provided with a plurality of holes and the conduit is provided with a plurality of matching holes.

6. The fire fighting apparatus of claim 5, further comprising a plurality of pins for securing the vertical stem within the opening on the top of said conduit when the holes on the vertical stem are lined up with the matching holes on the conduit, said pins being inserted into the lined up holes of the vertical stem and the conduit.

7. The fire fighting apparatus of claim 1, wherein said waterway has a vertical section and a horizontal section, said vertical section lying parallel to said conduit, said horizontal portion extending into the floor with the fire.

8. The fire fighting apparatus of claim 7, wherein the waterway is connected to a fire hose that supplies water to the fire fighting apparatus for dousing the fire.

9. The fire fighting apparatus o f claim 8, wherein said waterway has an upper end on the horizontal section and a bottom end on the vertical section, said upper end and said bottom end are each provided with a threaded fitting that are capable of engaging with a coupling mounted on said fire hose.

10. The fire fighting apparatus of claim 9, wherein said conduit has a pair of securement means that fixedly attach said waterway to said conduit.

11. A method of using a fire fighting apparatus that is mountable on a window sill of a floor with a fire therein, the fire fighting apparatus comprises a substantially elongated conduit having an upper portion with an opening therein, an anchor arm that may be mounted from said opening on said conduit, and a waterway that may be fastened to the conduit, the met hod comprising the steps of:

a) mounting said anchor arm to said opening on said conduit;

b) raising said conduit out of a window below the window sill of the floor with the fire therein, such that the anchor arm reaches upward towards the floor with the fire;

c) attaching the anchor arm on top of the window sill of the floor with the fire for ensuring that the fire fighting apparatus is securely suspended therefrom;

d) fastening said waterway to the conduit such that the waterway lies parallel to the conduit, wherein the waterway has a bottom end and a top end; and e) attaching a fire hose to said bottom end of the waterway.

12. The method of claim 11, wherein the step of attaching a fire hose to said bottom end of the waterway is followed by the step of supplying water to the fire hose, so that water enters into the bottom end of the waterway and is sprayed onto the fire from the top end.

* * * * *